United States Patent [19]

Michalowski

[11] Patent Number: 4,862,822

[45] Date of Patent: Sep. 5, 1989

[54] DRIP GUARD FOR BOATS

[76] Inventor: Leonard L. Michalowski, 35754 Fernwood, Westland, Mich. 48185

[21] Appl. No.: 263,289

[22] Filed: Oct. 27, 1988

[51] Int. Cl.[4] ..... B63H 16/06

[52] U.S. Cl. ..... 114/364; 114/361; 239/120

[58] Field of Search ..... 114/343, 355, 361, 364, 114/218, 219, 270, 182; 249/206; 312/229; 52/11, 15; 405/80, 118, 119; 239/120, 121, 104

[56] References Cited

U.S. PATENT DOCUMENTS

| | | | |
|---|---|---|---|
| 731,515 | 6/1903 | Sheeli | 114/364 |
| 2,544,599 | 3/1951 | Ueelen | 114/364 |
| 2,817,859 | 12/1957 | McCarthy | 114/364 |
| 3,000,021 | 9/1961 | Lang | 114/364 |
| 3,093,849 | 6/1963 | Iwanitza | 114/364 |
| 4,416,639 | 11/1983 | Gillmer | 114/364 |
| 4,628,855 | 12/1986 | Nishida | 114/364 |

*Primary Examiner*—Joseph F. Peters, Jr.
*Assistant Examiner*—Clifford T. Bartz
*Attorney, Agent, or Firm*—Charles W. Chandler

[57] ABSTRACT

A water drip guard installed on the outer side area of a boat hull to intercept water that would otherwise drain onto the hull side surface so as to form unsightly stains. A molding strip extending along the hull clamps the water drip guard to the hull surface.

8 Claims, 1 Drawing Sheet

DRIP GUARD FOR BOATS

BACKGROUND OF THE INVENTION

This invention relates to a drip guard mounted on a boat hull for draining surface water from the deck areas along side the hull into the water in which the boat is floating.

In many fishing boats and cabin cruisers, the deck area has an upstanding integral edge rail or rib running along the deck from the bow to the stern, to rigidify the deck and prevent haphazard drainage of water off the deck surface. At spaced intervals along the deck area, transverse drain grooves in the rail provide a path for water to drain from the deck and down the hull.

The water drains through the drain groove, onto a molding at the outer edge of the deck, and thence downwardly along the hull side surface.

Other boats do not have such a drainage groove but, nevertheless, have a low point shaped so the surface water drains down the hull.

After a period of time, the repeated water drainage forms a vertical stain or streak on the hull sidewall. The vertical streak detracts from the overall appearance of the boat.

SUMMARY OF THE INVENTION

The present invention is directed to a low cost drip guard for preventing streaks from developing on the hull sidewall surface due to water drainage from the deck area. The preferred drip guard is a simply constructed plastic plate inserted behind the molding that runs along the outer edge of the deck. The molding screws engage the upper edge of the drip guard to hold it in an essentially vertical position, extending downwardly along side the hull sidewall.

The drip guard hangs downwardly from the molding so that the lower edge of the guard is spaced outboard from the hull side wall surface. Drainage water flows from the molding onto the drip guard rather than onto the hull sidewall surface. Therefore the drainage water is prevented from forming streaks or stains on the hull surface.

One object of the invention is to provide a drip guard that is relatively unobtrusive, and that will not detract from the appearance of the boat on which it is installed.

A further object is to provide a drip guard that can be installed on a boat without drilling any holes in the boat or otherwise defacing the boat structure.

Still further objects and advantages of the invention will become readily apparent to those skilled in the art of the invention upon reference to the description of the preferred embodiment.

THE DRAWINGS

FIG. 3 is taken on line 3—3 in FIG. 4.

DESCRIPTION OF A PREFERRED EMBODIMENT OF THE INVENTION

Figure 1:
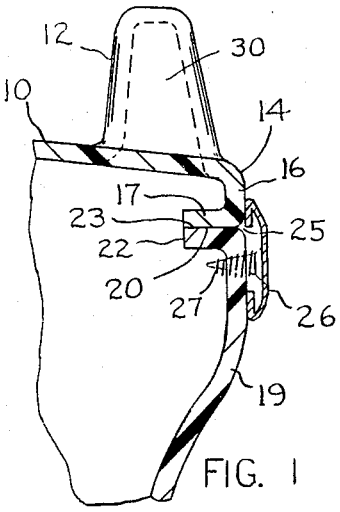
FIG. 1 is a fragmentary sectional view taken through the deck sidewall structure of a boat hull as seen along line 1—1 in FIG. 2.
Figure 2:
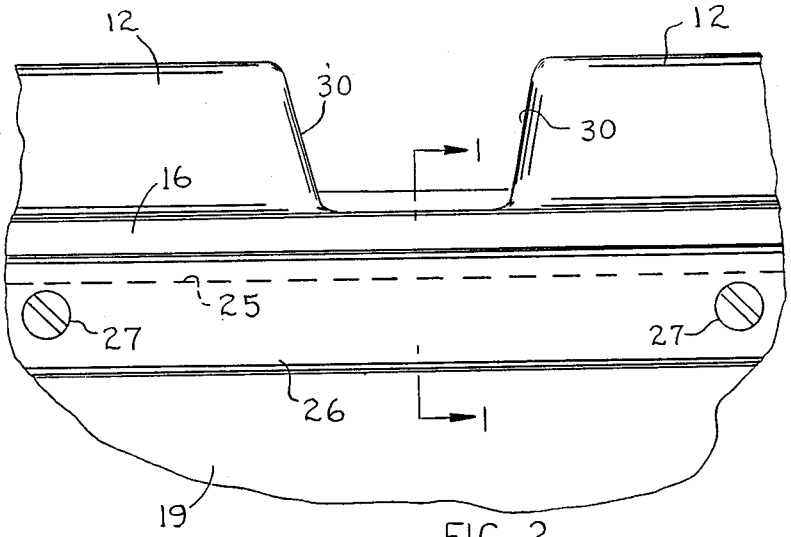
FIG. 2 is a fragmentary side elevational view of the FIG. 1 structure.

FIGS. 1 and 2 fragmentarily show a conventional boat hull structure, especially the hull area where the deck is joined to the hull sidewall. FIGS. 1 and 2 are taken "amidships", i.e. at a point approximately midway between the bow and stern areas of the boat.

The boat hull comprises a deck 10 having an upstanding rib or rail 12 near its outboard edge 14. The extreme edge of the deck turns downwardly at 16, and then inwardly to form flange 17. The under surface of flange 17 forms an attachment surface 20 for attaching the deck to the hull sidewall 19.

Hull side wall 19 includes an upper side edge area that is flanged inwardly at 22 to form an attachment surface 23 for attaching the hull sidewall to deck 10. Screws and/or adhesives may be used to affix hull flange 22 to deck flange 17. The flange connection usually extends entirely around the periphery of the hull. The interface between flanges 22 and 17 forms a parting line 25 between the hull sidewall and the deck.

Normally, a molding is fastened to the boat hull to overlie the parting line between the deck and the hull sidewall. The molding conceals the parting line and also protects against attack by the elements. The molding can comprise a stainless steel strip 26 having inturned flanges seating against the hull surface. Screw type fasteners 27 are extended through strip 26 into the hull wall at spaced points along the strip, e.g. about 18 inches apart. The screws are shown somewhat closer together in FIG. 2 than they would be in actual practice.

As shown in FIG. 2, a transverse drain groove 30 is formed in edge rail 12. Water can flow from deck 10 surface through groove 30 and onto molding 26. The water then flows downwardly on the exposed face of the molding and onto the surface of hull sidewall 19. Eventually the water leaves the hull surface at the water line, not shown. Usually there are one or two drain grooves 30 at each side of the boat.

After a period of time the repeated drainage of water downwardly on the hull sidewall leaves a stain on the hull surface. The stain extends the full vertical dimension, from a point just below molding 26 down to the water line. The stain or streak is about 2 or 3 inches wide and darker in color than the white hull surface. This stain detracts from the clean appearance of yachts, cruisers, and sailboats.

Figure 3:
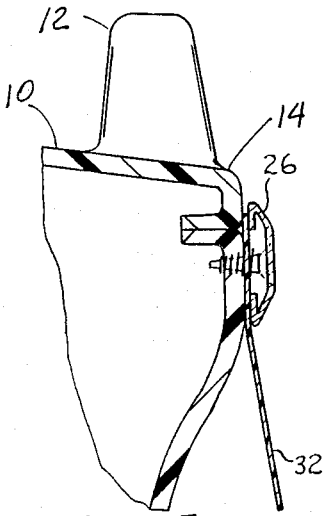
FIG. 3 is a view similar to FIG. 1, but showing the structure with a drip guard of my invention installed thereon.
Figure 4:
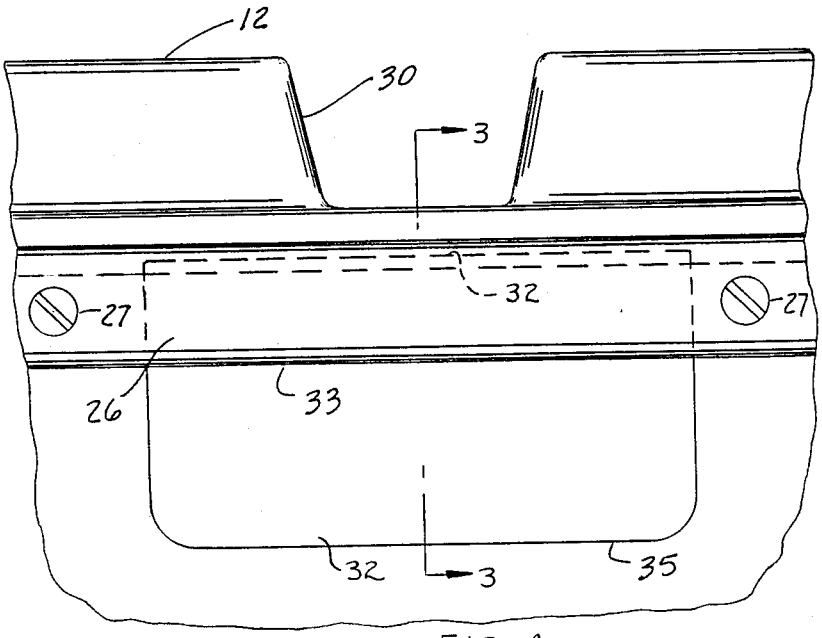
FIG. 4 is a fragmentary side elevational view of the FIG. 3 structure.

In FIGS. 3 and 4, I show a drip guard installed on the hull structure to prevent stains from forming on the hull side surface. The drip guard comprises a plate 32 that has an upper edge area inserted into the restricted space between molding 26 and the outer exposed surface of the hull. Before inserting plate 32 into the restricted space, it is necessary to unloosen two of the screws 27 in closest proximity to drain groove 30. Plate 32 is installed in the zone directly below groove 30. After the plate is in position, the two screws are retightened, such that concealed face areas of molding 26 have pressure engagement against the outer exposed face of plate 32.

In its installed position, plate 32 acts as a drip guard to intercept water draining from the lower edge of molding 26. The water flows onto the right (exposed) face of plate 32, instead of downwardly along the surface of hull sidewall 19. The plate is bent along score line 33 so that its lower edge 35 is spaced an appreciable distance away from the adjacent hull surface, e.g. at least ½ inch, such that water is discharged from the plate into the ocean or lake, rather than onto the hull surface.

Plate 32 is preferably a colorless translucent plastic material having a thickness about 0.020 inches. The relatively thin plate can be inserted into the crack between molding 26 and the hull surface without great difficulty (after screws 27 have been loosened).

The "colorless translucent" character of plate 32 is intended to make the plate as unobtrusive as possible, i.e. nearly invisible to persons a few feet away from the boat. The plate has a vertical dimension only about twice the vertical dimension of molding 26, e.g. about 2½ inches. The horizontal width of plate 32 is preferably about twice the width of drain groove 30 in order that the plate will be enabled to intercept all of the water passed through the groove, even when the plate is not installed exactly below the groove. The horizontal width of the drip guard is appreciably greater than the plate vertical dimension.

Figure 5:
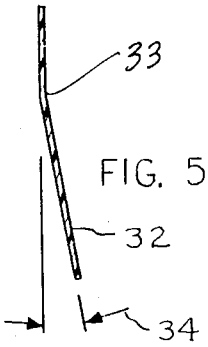
FIG. 5 is a sectional view through a drip guard constructed according to my invention. The guard is shown in the condition thereof prior to installation on the boat hull.

Plate 32 is manufactured in a flat condition. As seen in FIG. 5, the lower area is bent at an angle 34 about 10 degrees with respect to the plane of the unbent plate.

The plate is also useful as a drip guard when mounted on boats that do not have a drainage groove. In such a case the plate is mounted at the low point along the deck here the surface water drains off the deck.

The drawings show one form that the invention can take. It will be appreciated that the invention can take other forms.

I claim:

1. In a boat hull comprising a deck having a sidewall attachment surface, a sidewall having a deck attachment surface;

said attachment surfaces being in facial engagement to define a deck-side wall parting line;

a molding extending along the deck-side wall interface to overlie the parting line;

fasteners spaced along the molding to secure the molding to the hull;

said deck having an edge rail along and above the parting line, and a transverse drain groove formed in said edge rail to discharge water from the deck onto an exposed surface of the molding:

the improvement comprising a water drip guard extending downwardly from the molding in the zone directly below the drain groove to prevent down flow of water from the molding onto the hull sidewall;

said drip guard having an upper edge area thereof insertable between the molding and the hull such that the molding has pressure engagement with the outer exposed face of the drip guard.

2. The improvement of claim 1, wherein the drip guard is formed of a colorless translucent plastic material.

3. The improvement of claim 1, wherein the drip guard has a thickness of about 0.020 to 0.030 inch.

4. The improvement of claim 1, wherein the vertical dimension of the drip guard is substantially less than the horizontal dimension of the drip guard.

5. The improvement of claim 1, wherein the vertical dimension of the drip guard is approximately twice the vertical dimension of the molding.

6. The improvement of claim 1, wherein the lower edge of the drip guard plate is spaced an appreciable distance away from the adjacent hull surface.

7. The improvement of claim 1, wherein the horizontal dimension of the drip guard is substantially greater than the width of the drain groove.

8. In a boat hull having a deck with a sidewall attachment surface, a sidewall having a deck attachment surface; said attachment surfaces being in facial engagement to define a deck-sidewall parting line;

a molding extending below the deck surface and along the deck sidewall interface;

fasteners spaced along the molding to secure the molding to the hull;

the improvement comprising a water drip guard extending downwardly from the molding to guide the down flow of water from the deck; and said drip guard having an upper edge area thereof insertable between the molding and the hull such that the molding has pressure engagement with the outer exposed face of the drip guard.

* * * * *